US005741089A

United States Patent [19]

Gallaher et al.

[11] Patent Number: 5,741,089

[45] Date of Patent: Apr. 21, 1998

[54] METHOD FOR ENHANCED REDEPLOYABILITY OF HYJACK PLATFORMS

[75] Inventors: Dale Marion Gallaher, Metairie; George Emanuel Sgouros, New Orleans, both of La.

[73] Assignee: Shell Offshore Inc., New Orleans, La.

[21] Appl. No.: 370,767

[22] Filed: Dec. 23, 1994

[51] Int. Cl.[6] ..... E02B 17/02; E02B 17/08; E02D 25/00

[52] U.S. Cl. ..... 405/196; 405/195.1; 405/204

[58] Field of Search ..... 405/195.1, 196, 405/198, 200, 203, 204, 205, 207, 209, 224, 227

[56] References Cited

U.S. PATENT DOCUMENTS

| | | | |
|---|---|---|---|
| 3,347,053 | 10/1967 | Manning . | |
| 3,380,520 | 4/1968 | Pease . | |
| 3,428,338 | 2/1969 | Corwin | 285/39 |
| 3,535,884 | 10/1970 | Chaney . | |

(List continued on next page.)

FOREIGN PATENT DOCUMENTS

| | | |
|---|---|---|
| 2362975 | 4/1978 | France . |
| 2716948 A1 | 10/1978 | Germany . |
| 2736937 A1 | 2/1979 | Germany . |
| 201412 | 12/1982 | Japan . |

OTHER PUBLICATIONS

"Latest Technology Stresses Smarter, Quicker Operation" (Kurt S. Abrahm, International Editor and Henry D. Terrell, News Editor), *World Oil*, Jul. 1990, pp. 39–53.

"The Hydra-Lok Pile Swaging Tool," Marine Contractor Services, Inc. (MCS) (Copyright 1992), 18501 Aldine Westfield Rd., Houston, TX 77073.

"Unique Drilling/Production Jackup Set for 1993 Delivery," *Offshore*, vol. 51, No. 2, Feb. 1991, p. 42.

"Offshore Technology Conference '91," *World Oil*, Apr. 1991, pp. 121–135.

"Jack-Up Monopile Platform Uses Gravity-Base Storage," *Ocean Industry*, Apr./May 1991, p. 106.

George I. Viegas, "New Jackup Designs Proposed for Deepwater Operations," *Offshore*, vol. 51, No. 6, Jun. 1991, pp. 52–53.

"New Technology Is Shaped by North Sea, Subsea Markets" (Kurt S. Abraham, International Editor, Mark E. Teel, Engineering Editor, T. R. Wright, Jr., Editor), *World Oil*, Jul. 1991, pp. 39–56.

"Multi-Purpose Jack-Up Stands on Single Leg," *Ocean Industry*, Aug. 1991, pp. 39–40.

"European Operators, Drillers Embark on Cost-cutting Programs" (Neil Potter, News Editor, London), *Offshore*, Aug. 1991, pp. 33–40.

"Jack-Up Platform Suits Marginal Field Needs," *Ocean Industry*, Apr./May 1992, pp. 118–120.

Jeremy Beckman, "North Sea," *Offshore/Oilman*, vol. 52, No. 10, Oct. 1992, p. 12.

"Reusable Platform Transforms Dutch Gas Field Economics", *Offshore Engineer*, Oct. 1994, 7 pp.

"Swaged Connections for Piled Foundations," *Petroleum Engineer International*, vol. 54, May 1982, 12–16.

*Primary Examiner*—Dennis L. Taylor
*Attorney, Agent, or Firm*—Mark A. Smith

[57] ABSTRACT

A method is disclosed for redeploying an offshore platform structure from a first site to a second sight of different water depth in which the connection is released between a subsea jacket base and a plurality of piles which are anchored in the ocean floor at the first site. The offshore platform structure is vertically raised by pumping air into a tank member at the top of the subsea jacket base and the surface tower which is supported upon subsea jacket base is reworked while the jacket base is vertically raised. This operation is less difficult than attempting operations offshore on a horizontally disposed surface tower. The offshore platform structure is transported to the second site and the tank member is ballasted to vertically lower the offshore platform to the second site where it is installed.

10 Claims, 6 Drawing Sheets

U.S. PATENT DOCUMENTS

| | | | |
|---|---|---|---|
| 3,550,384 | 12/1970 | Bardgette et al. . | |
| 3,575,005 | 4/1971 | Sumner . | |
| 3,716,994 | 2/1973 | Pogonowski . | |
| 3,860,270 | 1/1975 | Arnold | 285/93 |
| 3,885,298 | 5/1975 | Pogonowski | 29/507 |
| 4,083,193 | 4/1978 | Evans . | |
| 4,117,690 | 10/1978 | Besse | 405/227 |
| 4,126,011 | 11/1978 | Lamy et al. | 405/196 |
| 4,147,385 | 4/1979 | van der Velden | 285/382.4 |
| 4,184,790 | 1/1980 | Bassett | 405/225 |
| 4,222,683 | 9/1980 | Schaloske et al. | 405/204 |
| 4,412,759 | 11/1983 | Britton et al. | 405/225 |
| 4,413,926 | 11/1983 | Ninet | 405/204 |
| 4,422,805 | 12/1983 | Sweatman | 405/225 |
| 4,436,454 | 3/1984 | Ninet et al. | 405/204 |
| 4,437,794 | 3/1984 | Grimsley et al. | 405/223.1 X |
| 4,456,404 | 6/1984 | Evans | 405/196 |
| 4,492,270 | 1/1985 | Horton | 166/358 |
| 4,501,514 | 2/1985 | Lowes | 405/227 |
| 4,505,620 | 3/1985 | Andrier | 405/224 |
| 4,583,881 | 4/1986 | Steele | 405/198 |
| 4,585,374 | 4/1986 | Regalbuto et al. | 405/227 |
| 4,607,982 | 8/1986 | Brasted et al. | 405/204 |
| 4,610,569 | 9/1986 | Finn et al. | 405/207 X |
| 4,633,953 | 1/1987 | LeBoeuf et al. | 166/358 |
| 4,666,340 | 5/1987 | Cox | 405/204 |
| 4,698,896 | 10/1987 | Osterwald et al. | 29/523 |
| 4,723,875 | 2/1988 | Sutton | 405/204 |
| 4,740,107 | 4/1988 | Casbarian et al. | 405/211 |
| 4,761,097 | 8/1988 | Turner | 405/204 |
| 4,762,442 | 8/1988 | Thomas et al. | 405/196 |
| 4,768,275 | 9/1988 | Schmitz | 29/407 |
| 4,805,945 | 2/1989 | Foucault et al. | 285/341 |
| 4,848,967 | 7/1989 | Weyler | 405/204 |
| 4,854,778 | 8/1989 | Valenzuela | 405/204 |
| 4,875,270 | 10/1989 | Krips et al. | 29/421.1 |
| 4,895,481 | 1/1990 | Pepin-Lehalleur et al. | 405/204 X |
| 4,902,169 | 2/1990 | Sutton | 405/204 |
| 4,902,170 | 2/1990 | Knox et al. | 405/225 |
| 4,917,541 | 4/1990 | Carruba | 405/227 |
| 4,934,869 | 6/1990 | Brandon et al. | 405/199 |
| 5,028,171 | 7/1991 | Gray | 405/225 |
| 5,049,004 | 9/1991 | Niimura | 405/204 |
| 5,094,568 | 3/1992 | Carruba | 405/227 |
| 5,102,266 | 4/1992 | Carruba | 405/227 |
| 5,163,783 | 11/1992 | Fahrmeier et al. | 405/195.1 |
| 5,228,806 | 7/1993 | De Medieros, Jr. et al. | 405/231 |
| 5,288,174 | 2/1994 | Kjersem et al. | 405/196 |
| 5,356,239 | 10/1994 | Canton | 405/204 X |
| 5,445,476 | 8/1995 | Sgouros et al. | 405/203 X |

FIG. 9
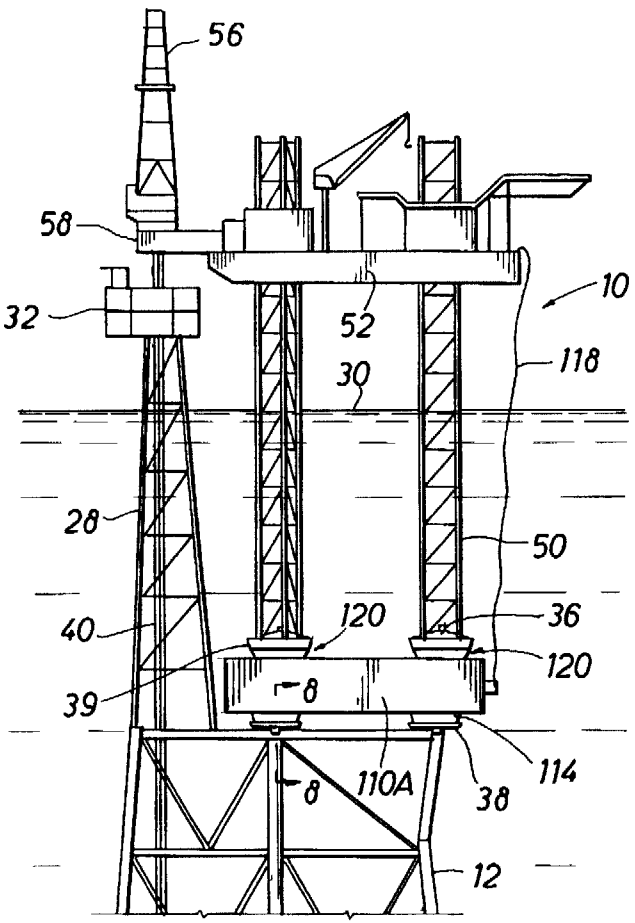
FIG. 5
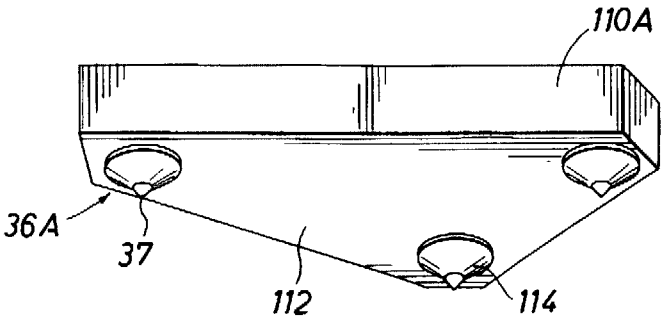
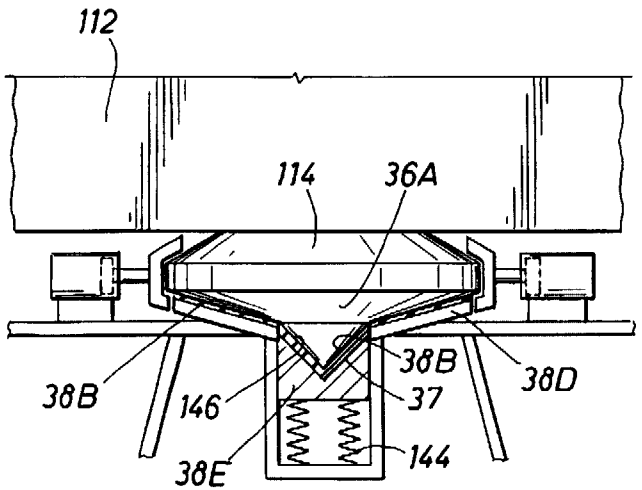
FIG. 8

METHOD FOR ENHANCED REDEPLOYABILITY OF HYJACK PLATFORMS

BACKGROUND OF THE INVENTION

The present invention relates to a platform and system for conducting offshore hydrocarbon recovery operations. More particularly, the present invention relates to a platform structure and system for allowing the use of a jack-up rig in deeper water.

Jack-up rigs provide a derrick and associated equipment for drilling, completing or working over a well. This equipment is mounted to a combined hull\deck which is capable of floating these facilities to site. A plurality of retractable legs are provided which renders the jack-up rig conveniently portable. Once floated into position for conventional operations, the legs are jacked-down until they engage the seafloor. Further jacking transfers the load from the buoyant hull to the legs, then lifts the hull/deck out of the water and above the splash zone to produce a stable, bottom founded offshore platform for conducting well operations.

A consideration of this design is that to best take advantage of the mobile nature of the facilities provided on the jack-up rig, the rig is removed after drilling is complete and does not remain deployed at the development during the production phase except, possibly, for temporary drilling and workover operations. The considerable investment in drilling, completion and workover equipment is best utilized by redeploying the jack-up rig to another location as soon as these operations are complete. Thus, surface completions for production are not accommodated on the jack-up rig itself. A small structure called a "well jacket" can be used with the jack-up rig to provide the benefits of a surface completion with the convenience of a jack-up rig. However, well jackets and jack-up rig combinations are limited to shallow water deployment. Further, practical limitations on the length of the retractable legs more directly restrict the depth in which jack-up rigs can be traditionally deployed.

The requirements of deeper water depths have most often been answered by the continued use of traditional bottom founded platform structures. Topside facilities provide convenient well access for production operations. However, such structures must dedicate a significant amount of their structural strength to supporting drilling facilities that are only required for a relatively short period of time in the life of the overall operations from the platform in recovering oil and gas from a reservoir. Further, the structure must be able to withstand the maximum design environmental conditions, the design hurricane criteria, with these drilling facilities in place.

Of course, recovery operations lead to depletion of the hydrocarbon reservoir and, in time, the platform loses its usefulness at a site. Nevertheless, the well jacket that forms the tower supporting the deck of the platform may be structural sound and capable of an extended useful life. However, salvage operations are difficult and another constraint of traditional well jackets is that they are design specific for a given water depth. This tends to substantially limit redeployment opportunities.

Certain designs have been proposed for "piggyback" deployment of a jack-up rig onto a subsea structure, yet these designs have carried forward many of the limitations of each structure producing a result that, although it increases water depth for the jack-up rig, otherwise remains the sum of the limitations of its constituent parts.

More recently a new platform concept has been proposed combining the benefits of jack-up rigs and traditional bottom founded platform structures, without carrying their drawbacks into the combination. Thus, the "Hyjack" platform has been proposed which combines a small surface tower sufficient to support production operations with a substantial jacket base which supports the surface tower and temporarily supports a jack-up rig for drilling operations. Following drilling, the jack-up rig is moved off and the small surface tower supports production operations. This is described in greater detail in U.S. patent application Ser. No. 08/129,820, filed Sep. 30, 1993, by Dale M. Gallaher et al for an Offshore Platform Structure and System. Further features that facilitate salvage and redeployment, particularly in combination with the foregoing platform concept, are described more fully in U.S. patent application Ser. No. 08/129,829, filed Sep. 30, 1993, by George E. Sgouros et al for a Reusable Offshore Platform Jacket. The full disclosure of each of these patent applications are hereby incorporated by reference and made a part hereof.

The forgoing salvage and redeployment provisions allow a second use of pile sleeves without drydock or expensive, complicated offshore operations. However, the offshore platform structure remains rather limited in the depths to which it can be redeployed. This is because the envelope is restricted both by the depth of the subsea rig support interface and the height of the surface tower over which the cantilever deck requires clearance to position the derrick. The first of these constraints involves major structural components. But the second constraint is only limiting due to the complexity of existing offshore operations and the expense and inconvenience of towing the offshore platform structure to dry dock or bringing a floating dry dock to it.

Thus, there continues to be a need in some circumstances for economically accommodating and even enhancing the reusabilty of hyjack platforms.

SUMMARY OF THE INVENTION

Toward the fulfillment of this need, the present invention is a method for redeploying an offshore platform structure from a first site to a second sight of different water depth in which the connection is released between a subsea jacket base and a plurality of piles which are anchored in the ocean floor at the first site. The offshore platform structure is vertically raised by pumping air into a tank member at the top of the subsea jacket base and the surface tower which is supported upon subsea jacket base is reworked while the jacket base is vertically raised. This operation is less difficult than attempting operations offshore on a horizontally disposed surface tower. The offshore platform structure is transported to the second site and the tank member is ballasted to vertically lower the offshore platform to the second site where it is installed.

A BRIEF DESCRIPTION OF THE DRAWINGS

The brief description above, as well as further objects and advantages of the present invention, will be more fully appreciated by reference to the following detailed description of the preferred embodiments which should be read in conjunction with the accompanying drawings in which:

FIG. 5 is a bottom perspective view of the rig mat of FIG. 4;

FIG. 8 is a partially cross sectioned view illustrative of one embodiment of a mat locking connection taken along line 8—8 in FIG. 9;

FIG. 9 is a side elevational view of a jack-up rig deployed upon the offshore platform structure;

A DETAILED DESCRIPTION OF ILLUSTRATIVE EMBODIMENTS

Figure 1:
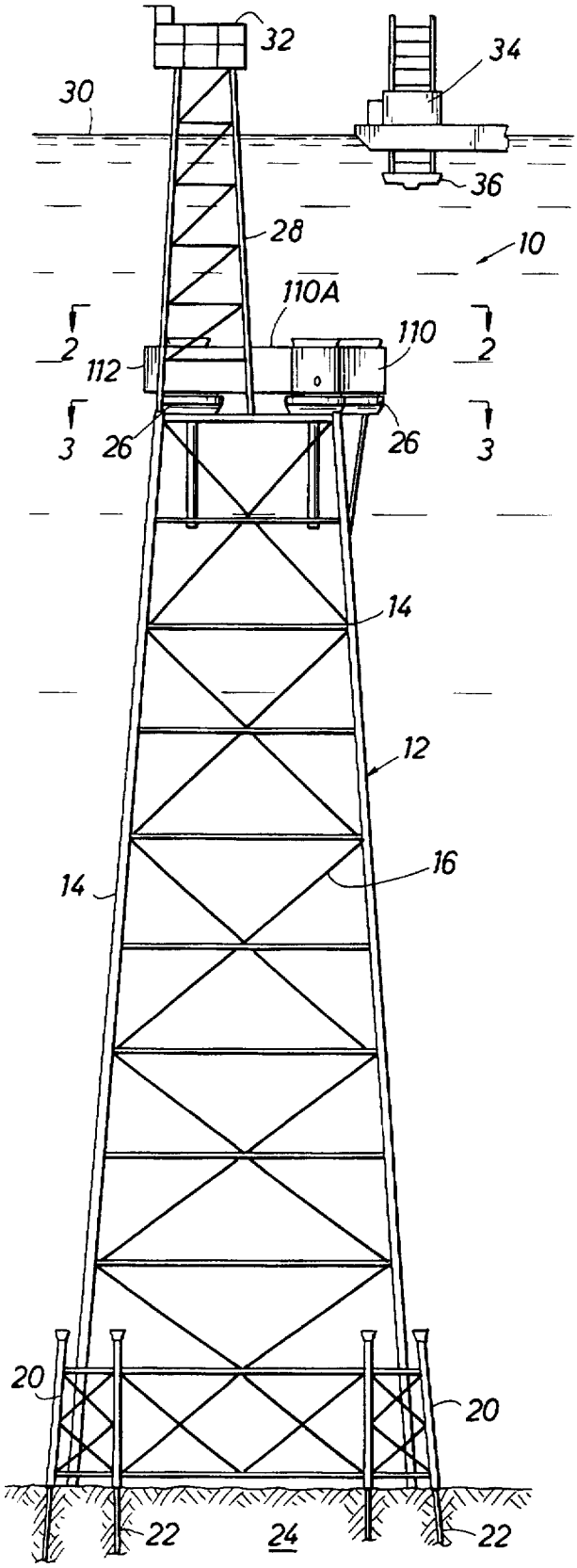
FIG. 1 is a side elevational view illustrating a deployed offshore platform structure.

In FIG. 1, rig support buoyancy tank 110 in the form of rig mat 110A is provided to compensate for the weight of jack-up rig 34 upon deployment onto bottom founded jacket base 12. In this illustration, jack-up rig 34 is shown in its initial approach.

Offshore platform structure 10 provides a subsea rig support interface 26 at the top of bottom founded jacket base 12 having legs 14 and a framework 16 of braces 18. The jacket base is pinned to ocean floor 24 with piles 22 which are secured to the jacket base at a plurality of pile sleeves 20.

A surface tower 28 is supported by jacket base 12 to present a platform deck 32 above ocean surface 30. Surface tower 28 is positioned to allow unobstructed access to subsea rig support interface 26. One convenient manner of providing this access for a three leg jack-up rig 34 is to place the surface tower on one comer of the jack-up rig and to provide legs 14 of a quadrilateral jacket base substantially aligned with the discrete contact points such as spud buckets 38 that generally correspond to the footprint of the jack-up rig.

Figure 2:
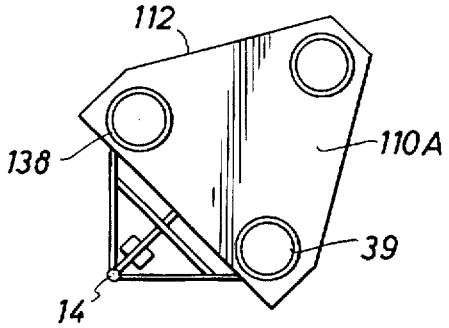
FIG. 2 is a top elevational view of a rig mat taken from line 2—2 in FIG. 1.
Figure 3:
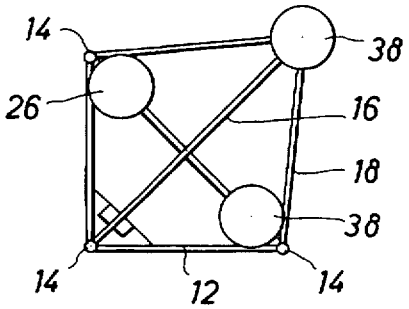
FIG. 3 is a cross sectional view of the offshore platform structure of FIG. 1 taken at line 3—3 of FIG. 1.
Figure 4:
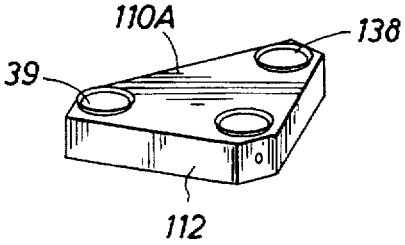
FIG. 4 is a top perspective view of a rig mat as deployed in FIG. 1.

Rig mat 110A is illustrated in greater detail in FIGS. 2, 4, 5 and 8. FIGS. 2 and 4 illustrate the top of the rig mat which presents secondary subsea support interface 138 on top of a tank member 112. The spud buckets of secondary subsea support interface 138 are positioned to receive feet 36 of jack-up rig 34. The bottom of tank member 112 presents jacket base interface 114 (see FIG. 5) which correspond to spud buckets 38 of the subsea rig support interface presented at the top of the jacket base. See FIG. 3.

Rig mat 110A has a selectively buoyant and ballastable tank member 112 with jacket base interface 114 on the lower surface (see FIG. 5) and secondary subsea rig support interface 39 on the upper surface (see FIG. 4). Internal structural members connect interfaces 114 and 39 in a load bearing relationship. Most conveniently, the load is transferred vertically between discrete aligned contact points. However, if necessary, it may be possible to fabricate a rig mat with structural framework suitable to distribute the load between the jacket base and the jack-up rig in other than direct vertical alignment. Thus, it may be possible to use rig mat 110A as an adapter to allow use of a jack-up rig having a dissimilar footprint from that which was the original design assumption when jacket base 12 was fabricated.

Figure 11D:
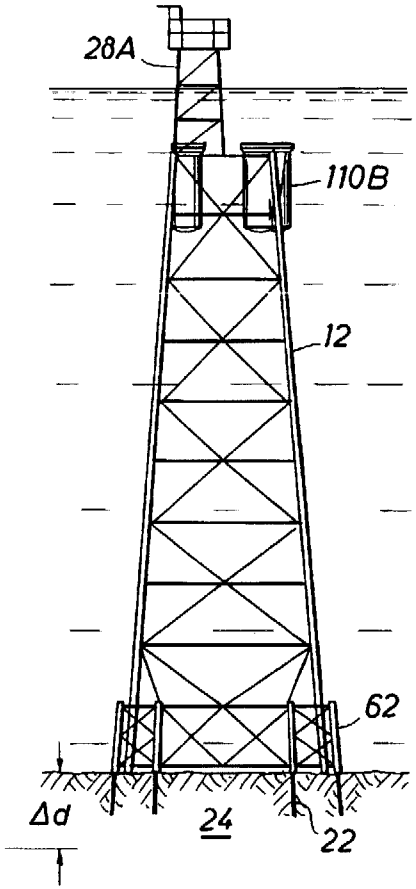
FIGS. 11A–11D are side elevational views of the salvage and redeployment of an offshore platform structure into a different water depth.
Figure 11C:
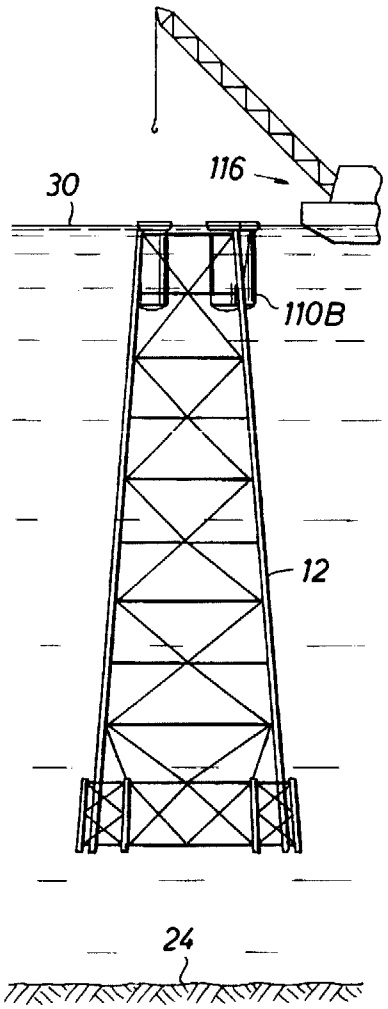
Figure 11B:
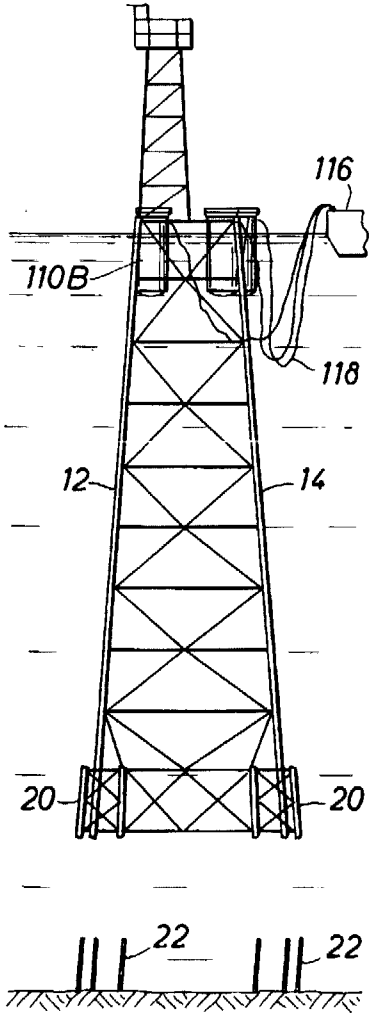
Figure 11A:
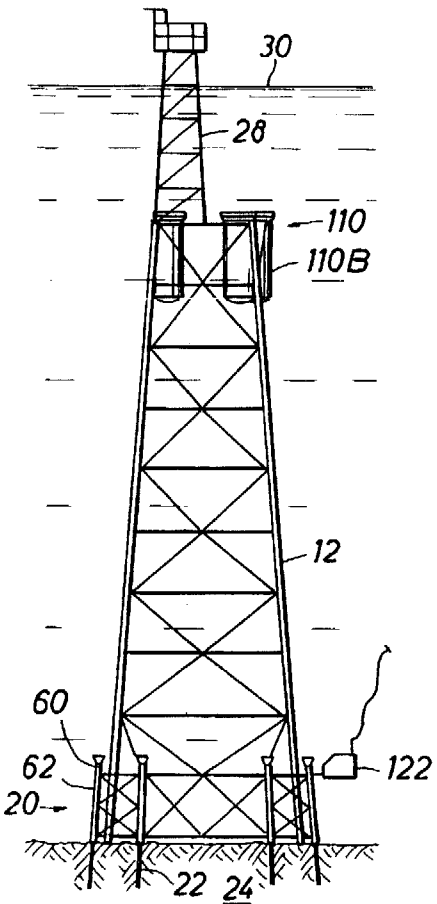
Figure 12A:
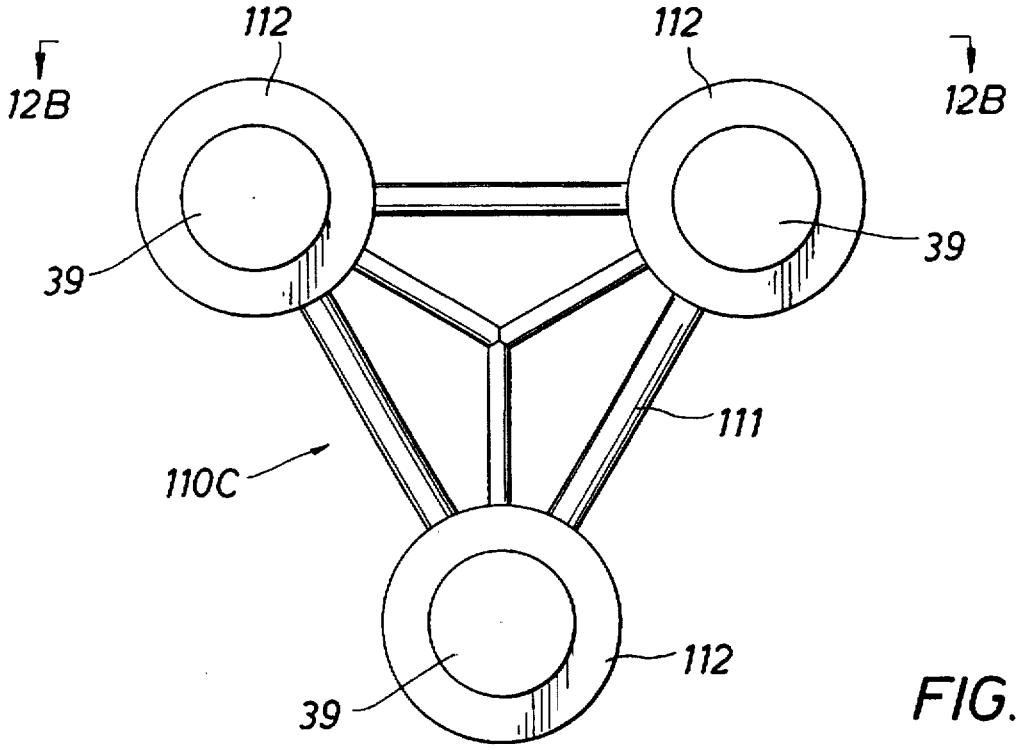
FIG. 12A is a top elevational view of an alternative embodiment of a rig support buoyancy tank.
Figure 12B:
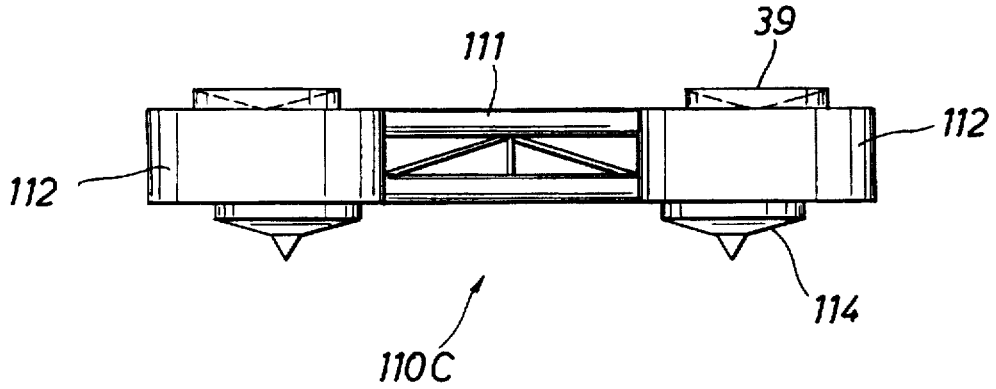
FIG. 12B is a side elevational view of the rig support buoyancy tank of FIG. 12A.

Dissimilar footprints in jacket base interface 114 and secondary subsea rig support interface 39 is one of the features illustrated in alternative embodiment 110C of the rig mat illustrated in FIGS. 12A and 12B. Here discrete tank members 112 are interconnected by external structural members or framework 111. It may be desirable to compartmentalize in the interior of the tank members. These compartments can be connected with valves that will provide greater control than merely providing an air line in, a valve in the bottom for water to escape when air enters, and a valve on top for air to be released when ballast is allowed to enter through the bottom. Providing extra control through valves and compartments can provide versatility in response to using a mixture of compressible and incompressible fluids to control buoyancy across a range of pressure conditions. This can limit the effective volume to which inserted gas can expand, e.g., during platform raising operations discussed below with FIGS. 11A–11D. Otherwise, the volume of the gas in the tank member will increase as the tank member rises and pressure decreases. The expanded volume of gas displaces more water, increasing the buoyancy of the platform, causing it to rise faster, etc.

Figure 6:
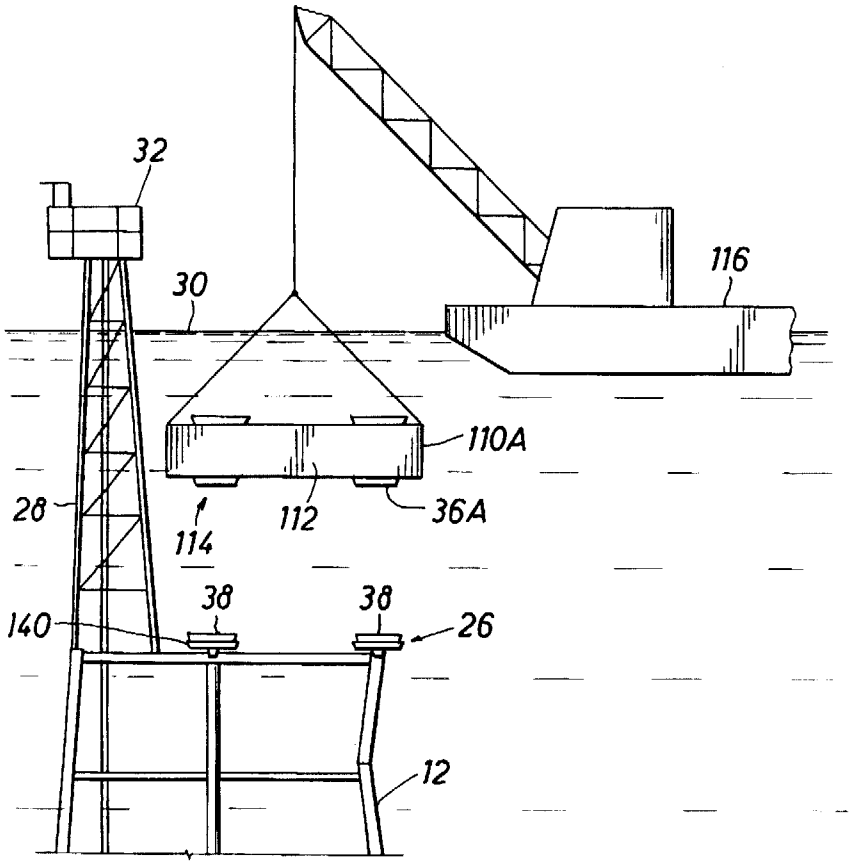
FIG. 6 is a side elevational view of an installation of a rig mat.

FIGS. 6–9 illustrate installation of rig mat 110A and deployment of jack-up rig 34. In FIG. 6, rig mat 110A has been partially ballasted, filled with sufficient water to make it less than neutrally buoyant. It is then lowered by crane barge 116 to the top of jacket base 12 adjacent surface tower 28, mating the jacket base interface with the rug support interface, bringing feet 36A of jacket base interface 114 into spud buckets 38 provided with a plurality of mat locking connections 140. Since these connections will be below the wave zone, but within the depth range for jack-up rigs, any number of positive control locking devises are possible, including hydraulic control, ROV operable, or even diver actuated.

FIG. 8 illustrates one such mat locking connection to secure rig mat 110A to jacket base 12. Here jacket base interface 114 presents a centering pin 37 extending from a rimmed foot 36A. The spud bucket is provided in the form of a steel lattice structure 38D which may be coated with a rubber or other elastomeric cushion 38B. A spring loaded landing receptacle 38E extends upwardly from the center of the lattice structure. Here this is illustrated with springs 144, the cathodic protection for which has been omitted for the sake of clarity. Other spring systems such as using elastomeric components or dampener systems may be alternatively used. Upon installation, centering pins 37 of jacket base interface 114 are guided into recess 146 in landing receptacle 38E which progressively loads and centers as the spring is deflected and rimmed foot 36A seats upon lattice structure legs 34 of jack-up rig 34. Hydraulically driven gripping arms 41 are deployed to engage the edges of foot 36A to secure the rig mat to the jacket base to enhance stability when the rig mat is buoyant and the jack-up rig is in place.

Figure 7:
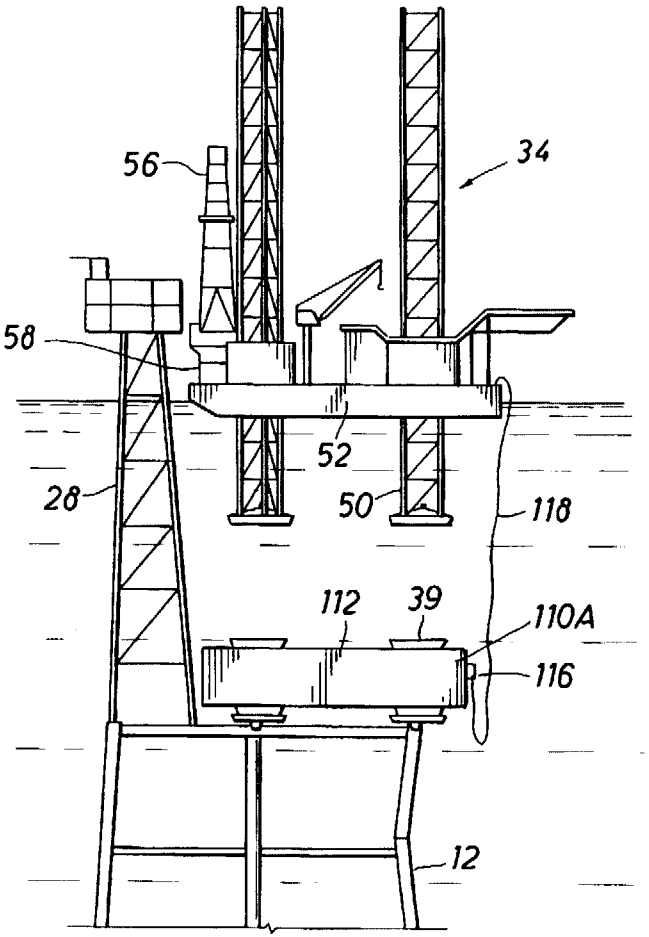
FIG. 7 is a side elevational view of a jack-up rig being deployed upon an offshore platform structure with a rig mat.

In FIG. 7, jack-up rig 34 has been floated on hull 52 into position adjacent surface tower 28 and legs 50 are being lowered toward secondary rig support interface 39 presented on the upper surface of tank member 112. Derrick 56 is withdrawn on cantilever deck 58 to enable this close maneuvering. An air compressor or other source of high pressure gas is conveniently provided on jack-up rig 34 and connected to rig mat 110A through conduit or air line 118. The interior of tank member 112 has ballast chambers into which air or another gas may be pumped for buoyancy and a valve system 116 through which gas may be pumped and displaced seawater released. Tradeoffs between temporarily loading to jacket base 12, temporarily loading to rig mat locking connections 140, design criteria and failure scenarios will determine whether rig mat 110A is made buoyant before, during or after installation of jack-up 34.

Further jacking of legs 50 brings feet 36 into contact with secondary subsea rig interface 39 and it may be desired to releasably lock feet 36 of the jack-up rig to the interface through a rig locking connection 120 (see FIG. 9) identical in construction and operation to the mat locking connection illustrated in FIG. 8. Further jacking of legs 50 raises hull 52 out of the water and to the desired platform height. At this elevation, cantilever deck 58 will clear platform deck 32 of surface tower 28 and derrick 56 can be brought into position to commence drilling operations through conductors 40.

After drilling operations are complete, jack-up rig 34 may be removed by essentially reversing the installation steps. Rig mat 110A may be ballasted to substantially neutral buoyancy by selectively allowing sea water to enter and the air to escape from tank member 112. Unless useful for controlling dynamic response as discussed below, the rig mat can then be removed with a crane barge.

FIGS. 10 and 11A–11D illustrate another embodiment of a rig support buoyancy tank 110, here in the form of a plurality of vertically oriented, elongated cylindrical tank members 110B. The elongated tank members are mounted to a plurality of levels of framework 16 in jacket base 12 in vertical alignment with discrete contact points in subsea rig interface 38.

Figure 10:
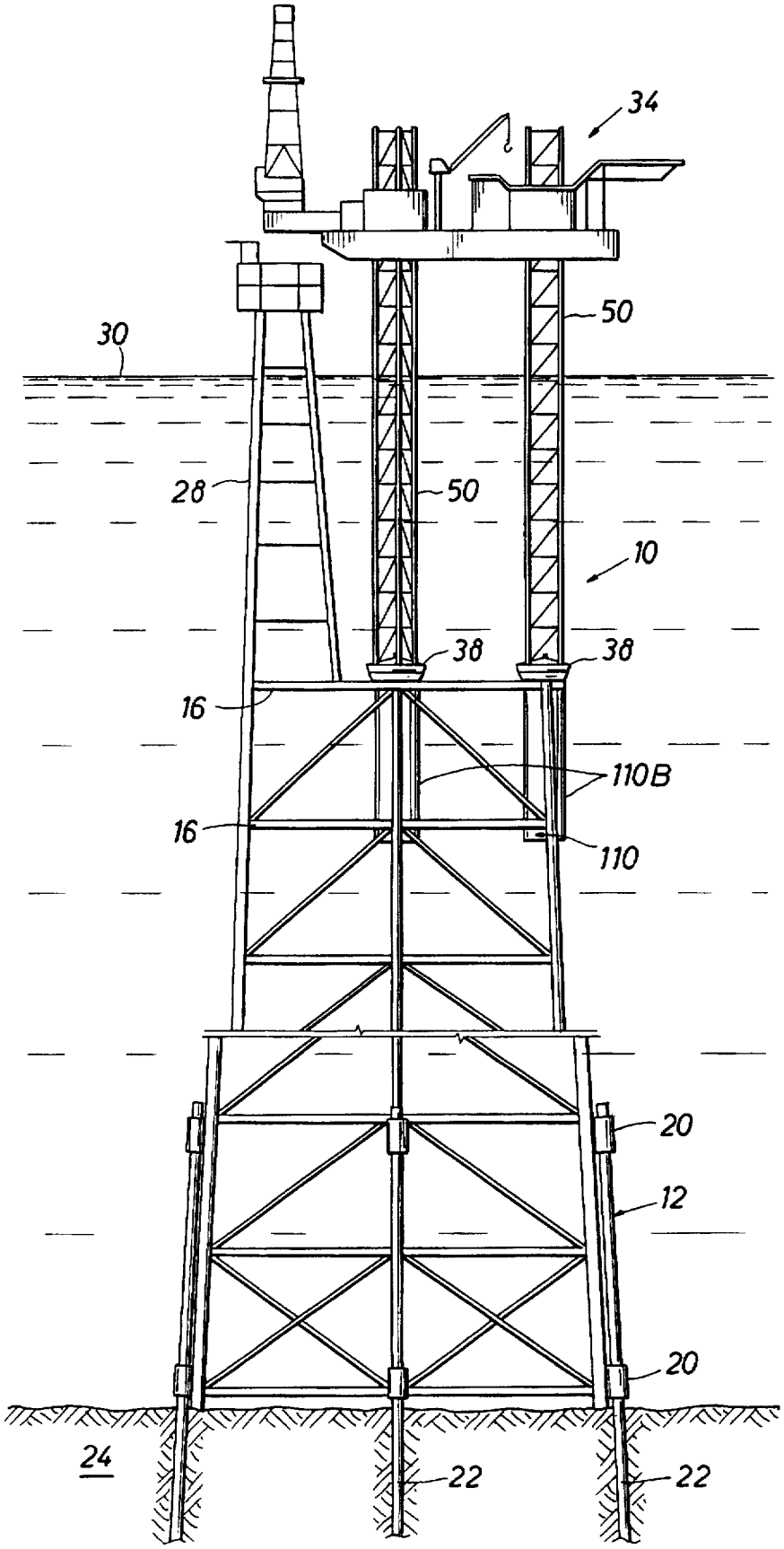
FIG. 10 is a side elevational view of a compliant tower embodiment of the present invention deploying a jack-up rig.

FIG. 10 illustrates also illustrates a compliant tower embodiment. Although dynamic response is a consideration for traditional bottom-founded platforms having fixed or rigid tower structures to deepwater, dynamic response becomes of more central concern for compliant towers. Compliant towers are designed to "give" in a controlled manner in response to dynamic environmental loads rather than to nearly rigidly resist those forces. A basic requirement in controlling this response is to produce a structure having harmonic frequencies or natural periods that avoid those encountered in nature. Here, jacket base 12 has parallel legs 14 to enhance its flexibility. For clarity sake, the middle regions of this long jacket base have been omitted from FIG. 10.

The total mass at the top to the jacket base is one of the controlling variables in defining the natural periods of the structure. Thus, offshore platform structure 10, with jack-up rig 34 in place, is one condition that must be accommodated. It may, however, be more difficult to design an offshore platform having a suitably wide range to accommodate both having the mass of the jack-up rig present and having it absent. It may also be difficult to find two separate ranges avoiding natural harmonics of the structure to accommodate the offshore platform in both drilling operations with the jack-up rig in place and in production operations with the jack-up rig removed.

Using ballastable tank member 110 to take on ballast when the jack-up rig is removed can substantially narrow the range of masses that must be accommodated. This may be conveniently provided by the same ballastable rig support buoyancy tank 110 which alleviated the load of the weight of the jack-up rig. Although a rig mat 110A may be deployed, the continued need for tank members, in both the presence or absence of the jack-up rig, is here accommodated by elongated, cylindrical, vertically oriented tank members 110B. If used to provide buoyancy support to offset the weight of jack-up rig 34 during drilling or other well operations, this buoyant reserve can be replaced with seawater with the removal of the jack-up rig, to substantially replace the mass of the jack-up rig. Further, since the tanks are submerged, this mass is added without introducing its corresponding weight in the system. This permits design for a more realistic (narrow) window avoiding the natural harmonic responses.

FIGS. 11A–11D illustrate a method for redeploying an offshore platform structure from a first site to a second site which has a different water depth. Selectively buoyant and ballastable tank members 110 at the top of jacket base 12 are very useful for this purpose.

Application Ser. No. 08/129,829, discussed above, discloses the use of staged pile sleeves 20 having a first stage 60 which projects above a second stage 62. On the initial deployment, the piles are locked to the pile sleeves in the first stage. Then, at time for retrieval and reuse, the first stage sleeve is accessible for cutting, e.g., through ROV operations. See ROV 122 in FIG. 11A. Severing the first stage sleeve 60 with the pile to sleeve connection inside and the top of the pile within releases the platform from its pinned connection at sea floor 24. Battered piles may require severing below the pile sleeve as well for releasing the jacket base.

Turning to FIG. 11B, water is then displaced with air pumped into selectively buoyant and ballastable tank members 110B. A suitable air pump may be supplied on crane barge 116. Similarly, air may also be pumped into one or more of legs 14 of jacket base 12 which are generally formed of hollow tubular goods. Jacket bases having a quadrilateral cross section may be helped by providing such buoyancy to the corner supporting surface tower 28. Other jacket bases may benefit from the additional buoyancy generally, in the jacket legs or through auxiliary provisions. However, the bulk of the buoyancy is provided at the top of jacket base and the jacket base is lifted off the sea floor and toward surface 30 where the vertically floating jacket base has sufficient stability to conduct offshore fabrication operations supported by crane barge 116. All or part of surface tower 28 is removed, see FIG. 11C, and a resized surface tower 28A is installed. See FIG. 11D. Thus, significant differences in water depth "$\Delta d$" may be accommodated, in offshore operations involving only the surface tower. Such operations provide the jacket base with convenient versatility that substantially enhances its reuse by facilitating resizing of the surface tower to correctly accommodate the water depth and cooperate with a cantilever deck mounted derrick on a jack-up rig.

The reworked jacket base is then towed to a new site and redeployed, ballasting the tank members 110 and legs 16. The base is then pinned to ocean floor 24 though piles 22 securely locked within pile sleeves 20 at second stage locking profile 62. For longer tow distances, it may be desirable to provide auxiliary buoyance to upend the platform for horizontal relocation. At site, it would be rotated to vertical and set down.

Other modifications, changes, and substitutions are also intended in the forgoing disclosure. Further, in some instances, some features of the present invention will be employed without a corresponding use of other features described in these illustrative embodiments. Accordingly, it is appropriate that the appended claims be construed broadly and in a manner consistent with the spirit and scope of the invention herein.

What is claimed is:

1. A method for redeploying an offshore platform structure from a first site to a second site of different water depth, comprising:

releasing the connection between a subsea jacket base and a plurality of piles which are anchored in the ocean floor at the first site, said releasing comprising cutting through a plurality of pile sleeves and the piles locked therein to remove pile-to-pile sleeve connections in an extended first stage of the pile sleeves;

vertically raising the offshore platform structure by pumping air into a plurality of the tank members, each being an elongated cylinder vertically aligned in load bearing relationship with underneath a discrete contact point of the subsea rig support interface corresponding to the to the footprint of a jack-up rig;

resizing a surface tower supported upon subsea jacket base while the jacket base is vertically raised;

towing the offshore platform structure to the second site;

vertically lowering the offshore structure by ballasting the tank member;

installing the platform at the second site with the surface tower above the ocean surface and a subsea rig support interface presented within the depth capability of a jack-up rig.

2. A method for redeploying an offshore platform structure from a first site to a second site of different water depth, comprising:

releasing the connection between a subsea jacket base and a plurality of piles which are anchored in the ocean floor at the first site;

vertically raising the offshore platform structure by pumping air into a tank member at the top of the subsea jacket base;

resizing a surface tower supported upon subsea jacket base while the jacket base is vertically raised;

towing the offshore platform structure to the second site;

vertically lowering the offshore structure by ballasting the tank member;

installing the platform at the second site with the surface tower above the ocean surface and a subsea rig support interface presented within the depth capability of a jack-up rig.

3. A method for redeploying an offshore platform structure in accordance with claim 2 wherein releasing the subsea jacket base from the ocean floor comprises cutting through a plurality of pile sleeves and the piles locked therein to remove pile-to-pile sleeve connections in an extended first stage of the pile sleeves.

4. A method for redeploying an offshore platform structure in accordance with claim 2 wherein vertically raising the offshore platform structure further comprises installing a rig mat having incorporating the tank member onto the subsea rig support interface presented at the top of the subsea jacket base.

5. A method for redeploying an offshore platform structure in accordance with claim 2 wherein there are a plurality of the tank members, each being an elongated cylinder vertically aligned in load bearing relationship with underneath a discrete contact point of the subsea rig support interface corresponding to the to the footprint of a jack-up rig.

6. A method for redeploying an offshore platform structure in accordance with claim 5, wherein the subsea jacket base has a quadrilateral cross section having four legs, three legs each providing direct support one of the discrete contact points, the forth leg providing principle support for the surface tower, and the method further comprising providing supplementary buoyancy under the surface tower.

7. A method for redeploying an offshore platform structure in accordance with claim 6 wherein vertically raising the offshore platform structure further comprises raising the subsea jacket base until the base of the surface tower is above the ocean surface.

8. A method for redeploying an offshore platform structure in accordance with claim 7 wherein resizing the surface tower comprises removing the old surface tower from the subsea jacket base and installing a new surface tower to the subsea jacket base.

9. A method for redeploying an offshore platform structure in accordance with claim 2 wherein resizing the surface tower comprises removing a deck from the surface tower, shortening the surface tower and installing another deck on the top of the shortened surface tower.

10. A method for redeploying an offshore platform structure in accordance with claim 5, wherein towing the offshore platform structure to the second site comprises:

providing buoyancy at the bottom of the subsea jacket base;

upending the offshore platform structure from its vertical orientation to a horizontal orientation;

towing the offshore platform structure in its horizontal orientation to the second site; and rotating the offshore platform structure to a vertical orientation.

* * * * *